United States Patent [19]

Elhaüs

[11] Patent Number: 4,578,030

[45] Date of Patent: Mar. 25, 1986

[54] METHOD OF AND A PLANT FOR PREHEATING AND, POSSIBLY, HEAT-TREATING AND SUBSEQUENTLY DIVIDING ROD-SHAPED MATERIAL INTO SLUGS

[76] Inventor: Friedrich W. Elhaüs, Dorfstrasse 21, 7761 Moos, Fed. Rep. of Germany

[21] Appl. No.: 623,966

[22] Filed: Jun. 25, 1984

[30] Foreign Application Priority Data

Jun. 24, 1983 [DE] Fed. Rep. of Germany ..... 3322874

[51] Int. Cl.[4] ..... F27B 9/12; F27B 9/02

[52] U.S. Cl. ..... 432/18; 432/128

[58] Field of Search ..... 432/18, 124, 128, 1

[56] References Cited

U.S. PATENT DOCUMENTS

| | | | |
|---|---|---|---|
| 3,198,501 | 8/1965 | Banister et al. | 432/124 |
| 3,837,794 | 9/1974 | Phillips | 432/18 |
| 3,953,247 | 4/1976 | Elhaus et al. | 148/13 |

FOREIGN PATENT DOCUMENTS

| | | | |
|---|---|---|---|
| 771433 | 10/1980 | U.S.S.R. | 432/128 |

OTHER PUBLICATIONS

Nielsen, Hufnagel & Ganoulis, *Aluminium-Taschenbuch* (Aluminium-Verlag GmbH-Dusseldorf 1974).

*Primary Examiner*—John J. Camby

*Attorney, Agent, or Firm*—Willian Brinks Olds Hofer Gilson & Lione Ltd.

[57] ABSTRACT

A plant for preheating and, possibly, heat-treating bars (2) of aluminum or aluminum alloys and subsequently severing the bars (2) into slugs (10) comprises a furnace (4) for the heat treatment and preheating only, if desired, billet hot shears (7), and a quick preheating furnace (16) connected between the hot shears and the furnace. Upon selection of the operating mode of heat treatment of the bars (2), the quick preheating furnace serves as cooling apparatus providing for temperature controlled cooling and corresponding renewed heating to a predetermined billet pressing temperature when the admissible temperature is not reached. When the plant operates alone to preheat the material, the quick preheating furnace serves as preheating furnace the exhaust gases of which serve to preheat the bars (2) in the furnace (4) through an exhaust gas conduit (19). This plant permits particularly economic and flexible operation, i.e. operation which is easily adaptable to batches of different compositions of alloys or conditions of textures, exact temperature control being achieved to the desired billet pressing temperature.

12 Claims, 3 Drawing Figures

PRIOR ART
FIG. 1
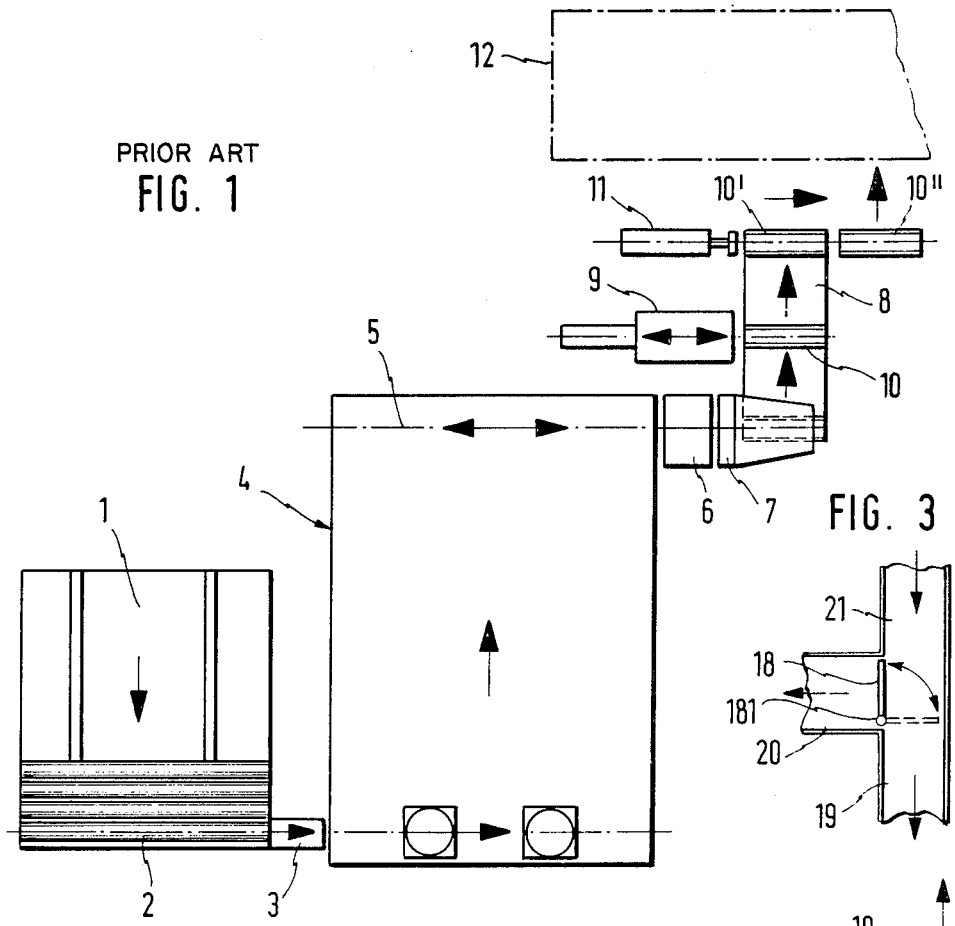
FIG. 3
FIG. 2
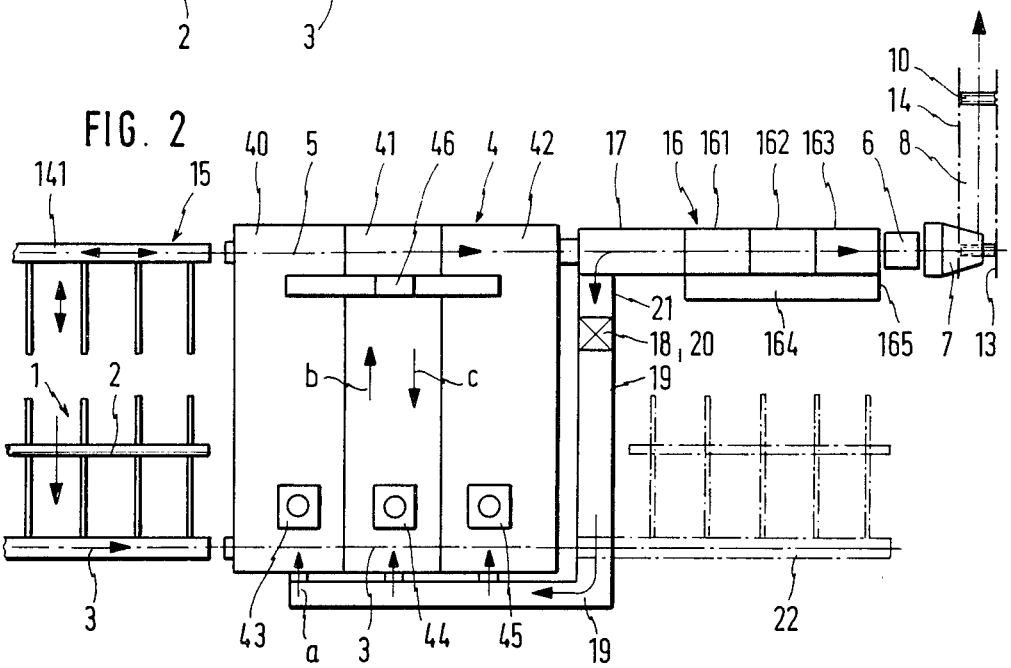

METHOD OF AND A PLANT FOR PREHEATING AND, POSSIBLY, HEAT-TREATING AND SUBSEQUENTLY DIVIDING ROD-SHAPED MATERIAL INTO SLUGS

The invention relates to a method of preheating and, possibly, heat-treating and subsequently dividing rod-shaped material, in particular of aluminum or aluminum alloys into slugs, and to a plant comprising a furnace for the preheating or heat treatment of the material and hot shears disposed downstream of the furnace.

A known plant of that kind as offered by the applicant is shown in FIG. 1. It comprises a magazine 1 for bars 2 of aluminum or aluminum alloys, a loading roller train 3 for charging a transit homogenizing furnace 4, for instance of the structure according to applicant's German patent No. 29 07 960 which corresponds to U.S. Pat. No. 4,404,043, and an unloading roller train 5, a driving roller frame 6, billet hot shears 7, and a billet transverse conveyor 8, structural units 6 to 8 possibly being designed, for instance, according to applicant's German patent No. 26 04 418 a shower 9 for cooling the slugs 10 cut off by the hot shears, and an ingot pusher 11 to move a slug 10 into loading position 10″ for an extruder 12.

The bars 2 are preheated in the transit homogenizing furnace and then severed in hot condition by the billet hot shears 7 to form slugs 10. The latter are cooled with water from the shower 9.

Such a plant has disadvantages:

It does not operate economically and safely unless it, or rather the transit homogenizing furnace 4 is completely full and the plant is used exclusively for homogenizing.

In that event the bars consisting of an aluminum alloy are heated to a temperature of, for instance, 580° C. As the pressing temperature is about 500° C., cooling is required. The plant shown in FIG. 1 is useful for a rather limited program of alloys only, a rather constant homogenizing temperture prevailing and large batch sizes being covered.

However, in extruding it is frequently necessary to no more than preheat material available and already homogenized elsewhere or to process alloys which cannot be homogenized for lack of flexibility of the transit homogenizing furnace 4 as to temperature selection or because the holding time in the homogenizing furnace is too long.

It is another disadvantage of the known plant according to FIG. 1 that the billet temperature prior to introducing the billets 10 into the press 12 cannot be controlled accurately enough or cannot be restored if it has fallen below the pressing temperature.

It is the object of the invention to provide a method and plant of the kind described initially by means of which rod-shaped material can be heat treated, particularly homogenized, and also can be preheated only, and the cooling of the material from the heat treatment temperature to the pressing temperature can be effected in controlled manner.

To meet this object it is provided, in accordance with the invention, with a method of the kind described initially that the material is selectively air-cooled or heated in controlled fashion in an operating cycle effected in time and place between the preheating or heat treatment and the shearing.

If the material is to be preheated only, it is provided in accordance with an advantageous further development of the method that the exhaust gases resulting from that operating cycle are used for preheating the material.

A plant including the features mentioned initially is characterized in accordance with the invention in that an apparatus of controllable temperature, to be operated selectively as a cooling apparatus or as a preheating furnace, is connected between the hot shears and the furnace.

It is advantageous if the quick preheating furnace is of a structure already proposed by the applicant (German patent application No. P 32 03 433.4 which corresponds to U.S. patent application Ser. No. 548,861, filed Sept. 21, 1983), hot gas or cooling air being applied selectively through radially directed nozzles to the singled material, and control zones being provided in which the temperature is controllable automatically to predetermined desired values (U.S Pat. No. 3,953,247).

The plant according to the invention is developed further in advantageous manner in that an exhaust gas conduit is provided between the furnace and the preheating furnace to pass the hot exhaust gases from the preheating furnace into the furnace, and in that the exhaust gas conduit includes an outlet into atmosphere and a valve which has a switching position blocking the exhaust gas conduit to provide communication between the preheating furnace and the outlet into the open so as to discharge the exhaust air resulting from the cooling when the plant is operated in the homogenizing mode.

The invention will be described in greater detail below, with reference to diagrammatic drawings, comparing the state of the art as shown in FIG. 1 with FIGS. 2 and 3.

FIG. 1 shows a known plant arrangement.

FIG. 2 shows the improved plant arrangement that operates in different homogenizing modes.

FIG. 3 shows a three way valve detail.

Structural units which are the same or have the same effect as with the state of the art according to FIG. 1 are designated by the same reference numerals in FIG. 2.

Also the plant shown in FIG. 2 comprises a magazine 1 for bars 2 of aluminum or an aluminum alloy, a loading roller train 3 for charging a transit homogenizing furnace 4 which may be of the structure according to applicant's German patent No. 29 07 960 (see U.S. Pat. No. 4,404,043) and include three parallel heating zones 40, 41, and 42, each having their own heating and temperature control, and in which the bars may be preheated in a preheating section and homogenized in a holding section. A temperature control with which the actual temperature is measured at the transition between the preheating section and the holding section zone determines the switch-on period of the heating or the timing speed of the transportation device for the bars through the furnace. Each heating zone has its own associated fan 43,44,45 for circulating the hot gases. The exhaust gases leave the furnace through a common exhaust gas outlet 46. For further details, reference is made to applicant's German patent No. 29 07 960 which corresponds to U.S. Pat. No. 4,404,043.

The preheated and, if desired, homogenized material is transferred singly by an unloading roller train 5 into a quick preheating furnace and then upon controlled cooling, if previous homogenizing is provided, and perhaps, if necessary, upon renewed heating or further heating, if only previous preheating is provided, it is conveyed by way of a driving roller frame 6 to billet hot shears 7 where it is divided into billets 10 which are supplied to the press 12, as with the known plant shown in FIG. 1.

The plant shown in FIG. 2 operates in different modes for homogenizing or preheating the material:

(1) Homogenizing

The bars 2 first are preheated in the preheating section of the furnace 4 and then homogenized in the holding section. At the same time they are being transported stepwise through the furnace 4. The unloading roller train 5 conveys the bars into the quick preheating furnace 16 designed as a transit furnace with an endless conveyor chain (not shown) where the bars are cooled in temperature controlled fashion by cooling air blown across the material or subjected to renewed heating if they should have cooled down below the pressing temperature because of delays in the unloading of bars. Control zones 161,162, and 163 of the quick preheating furnace 16 effect the stepwise cooling or renewed heating of the bars 2 transferred individually and successively into the quick preheating furnace 16, the desired temperature being reduced from control zone to control zone. Thus the bars 2 have the exact pressing temperature at the outlet of the furnace 16 toward the hot shears, and at this temperature the sheared billets 10 then may be supplied to the press.

If the billet temperature should drop too far down because of standstill of the press, the heating of the quick preheating furnace 16 is switched on automatically in the respective control or heating zone. In FIG. 2 the heating is indicated diagrammatically by the box 164 arranged next to the three control zones.

During the homogenizing operation described of the plant an exhaust gas conduit 19 between the furnace 4 and the quick preheating furnace 16 is interrupted by a valve 18 embodied by a three-way valve (FIG. 3). The three-way valve 18 is rotatable through 90° about an axis of rotation 181. Such pivoting movement permits communication to be established between the exhaust gas conduit 21 and an outlet 20 into the open while, at the same time, blocking an exhaust gas conduit 19 toward the furnace 4. The spent cooling air escapes through the outlet 20 to the outside, as well as exhaust gas upon renewed heating.

(2) Preheating When operating the plant shown in FIG. 2 for preheating alone of the rod-shaped material 2, the furnace 4 merely serves as preheating chamber which is heated by the exhaust gases of the quick preheating furnace 16 through the exhaust or flue gas conduit 19.

The passage of the material is the same as with the homogenizing operation and not described again. Each position or each xth position of the furnace 4 may be occupied by a bar 2. The occupation is selectable and automatically controllable. The best heating effect and thus the best fuel exploitation are obtained by close, i.e. complete occupation of the furnace 4. On the other hand, the plant has little flexibility as regards a change to a different alloy because in this case the store of material is great, or the preheating temperature supasses an admissible level.

The further temperature controlled preheating is effected in the quick preheating furnace 16 exactly to the desired pressing temperature. By virtue of its excellent control behavior—the heating 164 and its control permitting groupwise operation of the burners in the individual control zones 161,162,163—this furnace 16 allows very sensitive temperature control within wide limits of desired temperatures. This establishes great flexibility regarding the pressing temperature to be achieved of the billets 10.

The quick preheating furnace 16 which is constructed in accordance with U.S. Pat. No. 3,953,247 or the further development according to German patent application No. P 32 03 433.4 which corresponds to U.S. patent application Ser. No. 548,861, filed Sept. 21, 1983 supplies its exhaust gases at equal quantities, controlled by throttle flaps (not shown), through exhaust gas conduit 19, 21, with the three-way valve 18 (FIG. 3) in corresponding position, into the individual circulating zones 40,41,42 of the transit furnace 4 operating as a preheating chamber. The flue gas flows in the direction of arrows a into a gas conduit (not shown) disposed above the furnace chamber proper, and then passes the material in the opposite direction c, the material being moved stepwise in conveying direction b through the individual zones, and the gas passing on its heat content to the material. The gas is sucked off, circulated positively, and blown out by the fans 43,44,45.

At the end of the furnace 4 in the range of the unloading roller train 5 the bar temperature is monitored as to its still permissible level. If necessary, the flue gas supply is turned off automatically by valve 18 which then adopts its switching position of blocking the exhaust gas conduit 19 from the exhaust gas conduit 21 of the furnace 16.

It is convenient to provide process control for better temperature control in the quick preheating furnace 16 and in the furnace 4 so as to minimize the energy consumption in the quick preheating furnace 16. Thus the burner performance and consequently also the supply of flue gas to the furnace 4 are adapted automatically to the varying throughput of the plant. This is especially advantageous in consideration of the billet sequence time which varies greatly with extruders.

A dead section 17 corresponding approximately to the distance between the left end 165 in FIG. 2 of the quick preheating furnace 16 and a cutting-to-length stop 13 behind the billet hot shears 7, is provided between the unloading opening of the transit furnace 4 and the quick preheating furnace 16. This dead section 17 serves for better temperature control in consideration of the pilgrim step motion forwardly between a place approximately at the left end 165 of the furnace 4 and the cutting-to-length stop 13 and backwardly from the rear edge 14 of all sheared billets approximately to the end 165.

As shown in FIG. 2, an auxiliary magazine 15 to be served by the unloading roller train 5 may be provided in addition at the loading side of the furnace 4. This auxiliary magazine 15 permits an intermediate storage of bars and the loading of the furnace at the end thereof by means of an additional loading roller train 141 aligned with the unloading roller train 5. The auxiliary magazine 15 increases the flexibility of the plant, particularly when changing from homogenizing to preheating operation.

What is claimed is:

1. In a method of preheating and, possibly, heat-treating rod-shaped material, in particular of aluminum or aluminum alloys, in a furnace and subsequently dividing said rod-shaped material into slugs with hot shears, the improvement comprising the step of:

selectively air-cooling or heating the material in controlled fashion as said material is passed between the furnace and the hot shears.

2. The method as claimed in claim 1, further comprising the step of preheating the material by exhaust gases resulting from said selective air-cooling or heating of material.

3. In a plant comprising a furnace for the preheating or heat treatment of rod-shaped material, in particular of aluminum or aluminum alloys, and hot shears disposed downstream of the furnace for dividing the material into slugs, the improvement comprising:

an apparatus of controllable temperature, connected between the hot shears and the furnace, said apparatus of controllable temperature being selectively operable as a cooling apparatus or as a preheating furnace.

4. The plant as claimed in claim 3, wherein the apparatus comprises a quick preheating furnace which selectively applies hot gas or cooling air through radially directed nozzles to the singled material and includes control zones in which the temperature is automatically controllable to predetermined billet pressing temperatures.

5. The plant as claimed in claim 3, further comprising an exhaust gas conduit positioned between the furnace and the preheating furnace to pass the hot exhaust gases from the preheating furnace into the furnace, said exhaust gas conduit including an outlet into the atmosphere and a valve which has a switching position blocking the exhaust gas conduit to provide communication between the preheating furnace and the outlet so as to discharge the exhaust air resulting from the cooling.

6. The plant as claimed in claim 3, wherein said furnace has a supply side and an unloading side, further comprising an auxiliary magazine positioned at the supply side of the furnace.

7. In a plant comprising a furnace for the preheating or heat treatment of rod-shaped material, in particular of aluminum or aluminum alloys, and hot shears disposed downstream of the furnace for dividing the material into slugs, the improvement comprising:

an apparatus of controllable temperature, arranged between the hot shears and the furnace, said apparatus of controllable temperature being selectively operable as a cooling apparatus or as a preheating furnace; and, an exhaust gas conduit positioned between the furnace and the preheating furnace to pass the hot exhaust gases from the preheating furnace into the furnace, said exhaust gas conduit adapted to be blocked for operating said apparatus of controllable temperature as a cooling apparatus.

8. The plant as claimed in claim 7, wherein the apparatus of controllable temperature comprises a quick preheating furnace which selectively applies hot gas or cooling air through radially directed nozzles to the singled material, said quick preheating furnace including control zones in which the temperature is automatically controllable to predetermined billet pressing temperatures.

9. The plant as claimed in claim 8, wherein said exhaust gas conduit includes an outlet into the atmosphere and a valve which has a switching position blocking the exhaust gas conduit to provide communication between the preheating furnace and the outlet so as to discharge the exhaust air resulting from the cooling.

10. In a method of preheating and, possibly, heat-treating rod-shaped material, in particular of aluminum or aluminum alloys, in a furnace and subsequently dividing said rod-shaped material into slugs with hot shears, the improvement comprising the steps of:

conveying said material from said furnace to a quick preheating furnace arranged between said furnace and said hot shears;

cooling said material in temperature controlled fashion by blowing cool air across said material while said material is in said quick preheating furnace or subjecting said material to renewed heating while said material is in said quick preheating furnace if said material has cooled down below a predetermined temperature.

11. The method as claimed in claim 10 further comprising the step of discharging spent cooling air from said quick preheating furnace into the atmosphere.

12. The method as claimed in claim 10 further comprising the step of heating said furnace by the exhaust gases from said quick preheating furnace.

* * * * *